US011274887B2

(12) United States Patent
Patterson et al.

(10) Patent No.: US 11,274,887 B2
(45) Date of Patent: Mar. 15, 2022

(54) ALUMINUM HEAT EXCHANGER WITH FIN ARRANGEMENT FOR SACRIFICIAL CORROSION PROTECTION

(71) Applicant: CARRIER CORPORATION, Palm Beach Gardens, FL (US)

(72) Inventors: Matthew Patterson, East Syracuse, NY (US); Anais Espinal, Burlington, MA (US); Aaron T. Nardi, East Granby, CT (US); Mark R. Jaworowski, Sarasota, FL (US); Catherine Thibaud, Cork (IE); Tobias H. Slenel, Baldwinsville, NY (US); Luis Felipe Avila, Manlius, NY (US); Jefferi J. Covington, Baldwinsville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/734,493

(22) PCT Filed: Dec. 19, 2019

(86) PCT No.: PCT/US2019/067452

§ 371 (c)(1),
(2) Date: Dec. 2, 2020

(87) PCT Pub. No.: WO2020/132229

PCT Pub. Date: Jun. 25, 2020

(65) Prior Publication Data

US 2021/0348858 A1 Nov. 11, 2021

Related U.S. Application Data

(60) Provisional application No. 62/781,896, filed on Dec. 19, 2018.

(51) Int. Cl.
*F28F 19/06* (2006.01)
*F28F 21/08* (2006.01)
(Continued)

(52) U.S. Cl.
CPC ..... *F28F 19/004* (2013.01); *F28F 1/30* (2013.01); *F28F 21/084* (2013.01); *F28F 1/10* (2013.01);
(Continued)

(58) Field of Classification Search
CPC .... F28F 19/004; F28F 1/30; F28F 1/26; F28F 1/22; F28F 1/12; F28F 1/10; F28F 21/084; F28F 2215/00; F28F 2215/04
(Continued)

(56) References Cited

U.S. PATENT DOCUMENTS 4,203,490 A 5/1980 Terai et al.
4,238,233 A 12/1980 Yamada et al.
(Continued)

FOREIGN PATENT DOCUMENTS

WO 2012018536 A2 2/2012
WO 2013155384 A2 10/2013
(Continued)

OTHER PUBLICATIONS

International Search Report for International Application No. PCT/US2019/067452; Application Filing Date Dec. 19, 2019; dated Mar. 26, 2020; 5 pages.
(Continued)

*Primary Examiner* — Joel M Attey
(74) *Attorney, Agent, or Firm* — Cantor Colburn LLP

(57) ABSTRACT

A heat exchanger is disclosed. The heat exchanger includes a hollow tube including a first aluminum alloy extending along an axis from a tube inlet to tube outlet. A first plurality of fins including a second aluminum alloy extends out-
(Continued)

wardly from an outer surface of the tube. A second plurality of fins including a third aluminum alloy extends outwardly from the outer surface of the tube, interspersed along the axis with the fins including the second aluminum alloy. The third aluminum alloy is less noble than each of the first aluminum alloy and the second aluminum alloy, and includes an alloying element selected from tin, indium, gallium, or combinations thereof. A first fluid flow path is disposed through hollow tube from the tube inlet to the tube outlet. A second fluid flow path is disposed across an outer surface of the hollow tube through spaces between adjacent fins.

16 Claims, 4 Drawing Sheets

(51) Int. Cl.

| | |
|---|---|
| ***F28F 19/00*** | (2006.01) |
| ***F28F 1/30*** | (2006.01) |
| *F28F 1/10* | (2006.01) |
| *F28F 1/12* | (2006.01) |
| *F28F 1/26* | (2006.01) |
| *F28F 1/22* | (2006.01) |

(52) U.S. Cl.
CPC . *F28F 1/12* (2013.01); *F28F 1/22* (2013.01); *F28F 1/26* (2013.01); *F28F 2215/04* (2013.01)

(58) Field of Classification Search
USPC ..... 165/134.1
See application file for complete search history.

(56) References Cited

U.S. PATENT DOCUMENTS

| | | | | |
|---|---|---|---|---|
| 4,244,756 | A | 1/1981 | Tanabe et al. | |
| 4,571,368 | A | 2/1986 | Fenoglio et al. | |
| 4,749,627 | A | 6/1988 | Ishikawa et al. | |
| 4,991,647 | A | 2/1991 | Kawabe et al. | |
| 5,217,547 | A | 6/1993 | Ishikawa et al. | |
| 5,289,872 | A | 3/1994 | Kent | |
| 6,325,138 | B1 * | 12/2001 | Garosshen | C23C 26/00 165/133 |
| 6,578,628 | B1 * | 6/2003 | Garosshen | C23C 30/00 165/133 |
| 8,668,993 | B2 | 3/2014 | Tatsumi et al. | |
| 2009/0260794 | A1 | 10/2009 | Minami et al. | |
| 2013/0098591 | A1 | 4/2013 | Taras et al. | |
| 2015/0068714 | A1 * | 3/2015 | Garosshen | F28F 19/06 165/134.1 |
| 2015/0075760 | A1 * | 3/2015 | Huang | C22C 1/06 165/181 |
| 2015/0354376 | A1 | 12/2015 | Garosshen | |
| 2018/0003450 | A1 * | 1/2018 | Garosshen | F28F 1/126 |
| 2018/0029175 | A1 * | 2/2018 | Singh | F28F 1/20 |

FOREIGN PATENT DOCUMENTS

| | | | |
|---|---|---|---|
| WO | 2016100640 | A1 | 6/2016 |
| WO | 2017034486 | A1 | 3/2017 |
| WO | 2020132229 | A1 | 6/2020 |

OTHER PUBLICATIONS

Pourgharibshahi, M. and Lambert, Paul (2016). The role of indium in the activation of aluminum alloy galvanic anodes. Materials and Corrosion, 67 (8), 857-866.

Written Opinion for International Application No. PCT/US2019/067452; Application Filing Date: Dec. 19, 2019; dated Mar. 26, 2020; 6 pages.

* cited by examiner

ALUMINUM HEAT EXCHANGER WITH FIN ARRANGEMENT FOR SACRIFICIAL CORROSION PROTECTION

CROSS REFERENCE TO RELATED APPLICATIONS

This application is a National Stage application of PCT/US2019/067452, filed Dec. 19, 2019, which claims the benefit of U.S. Provisional Application No. 62/781,896, filed Dec. 19, 2018, both of which are incorporated by reference in their entirety herein.

BACKGROUND

Exemplary embodiments pertain to the art of heat exchangers and, more specifically, to aluminum alloy heat exchangers.

Heat exchangers are widely used in various applications, including but not limited to heating and cooling systems including fan coil units, heating and cooling in various industrial and chemical processes, heat recovery systems, and the like, to name a few. Many heat exchangers for transferring heat from one fluid to another fluid utilize one or more tubes through which one fluid flows while a second fluid flows around the tubes. Heat from one of the fluids is transferred to the other fluid by conduction through the tube walls. Many configurations also utilize fins in thermally conductive contact with the outside of the tube(s) to provide increased surface area across which heat can be transferred between the fluids, improve heat transfer characteristics of the second fluid flowing through the heat exchanger and enhance structural rigidity of the heat exchanger. Such heat exchangers include microchannel heat exchangers and round tube plate fin (RTPF) heat exchangers.

Heat exchanger tubes may be made from a variety of materials, including metals such as aluminum or copper and alloys thereof. Aluminum alloys are lightweight, have a high specific strength and high thermal conductivity. Due to these excellent mechanical properties, aluminum alloys are used to manufacture heat exchangers for heating or cooling systems in commercial, industrial, residential, transport, refrigeration, and marine applications. However, aluminum alloy heat exchangers can be susceptible to corrosion. Corrosion can eventually lead to a loss of refrigerant from the tubes and failure of the heating or cooling system. Sudden tube failure results in a rapid loss of cooling and loss of functionality of the heating or cooling system and can create an environmental problem due to release of refrigerant to the atmosphere. Many different approaches have been tried with regard to mitigating corrosion and its effects; however, corrosion continues to be a seemingly never-ending problem that needs to be addressed.

BRIEF DESCRIPTION

A heat exchanger is disclosed. The heat exchanger includes a hollow tube comprising a first aluminum alloy extending along an axis from a tube inlet to a tube outlet. A first plurality of fins comprising a second aluminum alloy extends outwardly from an outer surface of the tube. A second plurality of fins comprising a third aluminum alloy extends outwardly from the outer surface of the tube, interspersed along the axis with the fins comprising the second aluminum alloy. The third aluminum alloy is less noble than each of the first aluminum alloy and the second aluminum alloy, and comprises an alloying element selected from tin, indium, gallium, or combinations thereof. A first fluid flow path is disposed through hollow tube from the tube inlet to the tube outlet. A second fluid flow path is disposed across an outer surface of the hollow tube through spaces between adjacent fins.

In some embodiments, a ratio of the number of fins in the first plurality of fins to the number of fins in the second plurality of fins can be from 1:2 to 30:1.

In any one or combination of the foregoing embodiments, the interspersal of the second plurality of fins among the first plurality of fins can be evenly distributed along the axis.

In any one or combination of the foregoing embodiments, the third aluminum alloy can be concentrated toward an inlet to a fluid flow path on the outside of the tube between the fins.

In any one or combination of the foregoing embodiments, the second plurality of fins can be concentrated toward an inlet to a fluid flow path on the outside of the tube between the fins.

In any one or combination of the foregoing embodiments, the first plurality of fins can be free of the third aluminum alloy.

In any one or combination of the foregoing embodiments, the third alloy can further comprise zinc or magnesium.

In any one or combination of the foregoing embodiments, the second aluminum alloy can be less noble than the first aluminum alloy.

In any one or combination of the foregoing embodiments, the second plurality of fins can individually include the third aluminum alloy along the entirety of its surface.

In any one or combination of the foregoing embodiments, the second plurality of fins can individually include the third aluminum alloy along less than the entirety of its surface.

In any one or combination of the foregoing embodiments, the hollow tube can be configured as a hollow cylinder.

In any one or combination of the foregoing embodiments, the first and second pluralities of fins can be arranged as plates that include openings through which the hollow tube is disposed.

In any one or combination of the foregoing embodiments, the heat exchanger can comprise a plurality of hollow tubes or a plurality of hollow tube sections extending parallel to said axis.

In any one or combination of the foregoing embodiments, the plurality of hollow tubes or hollow tube sections can extend through a plurality of openings in said plate or plates.

Also disclosed is a heat transfer system comprising a heat transfer fluid circulation loop in operative thermal communication with a heat source and a heat sink, and wherein the heat exchanger of any one or combination of the foregoing embodiments is disposed as a thermal transfer link between the heat transfer fluid and the heat sink or heat source.

Also disclosed is a heat transfer system comprising a heat transfer fluid circulation loop in operative thermal communication with an indoor conditioned air space and an outdoor air space, including the heat exchanger of any one or combination of the foregoing embodiments arranged with the first fluid flow path in operative fluid communication with the heat transfer fluid circulation loop.

In any one or combination of the foregoing embodiments, the second fluid flow path can be in operative fluid communication with the conditioned air space.

In any one or combination of the foregoing embodiments, the second fluid flow path can be in operative fluid communication with the outdoor air space.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
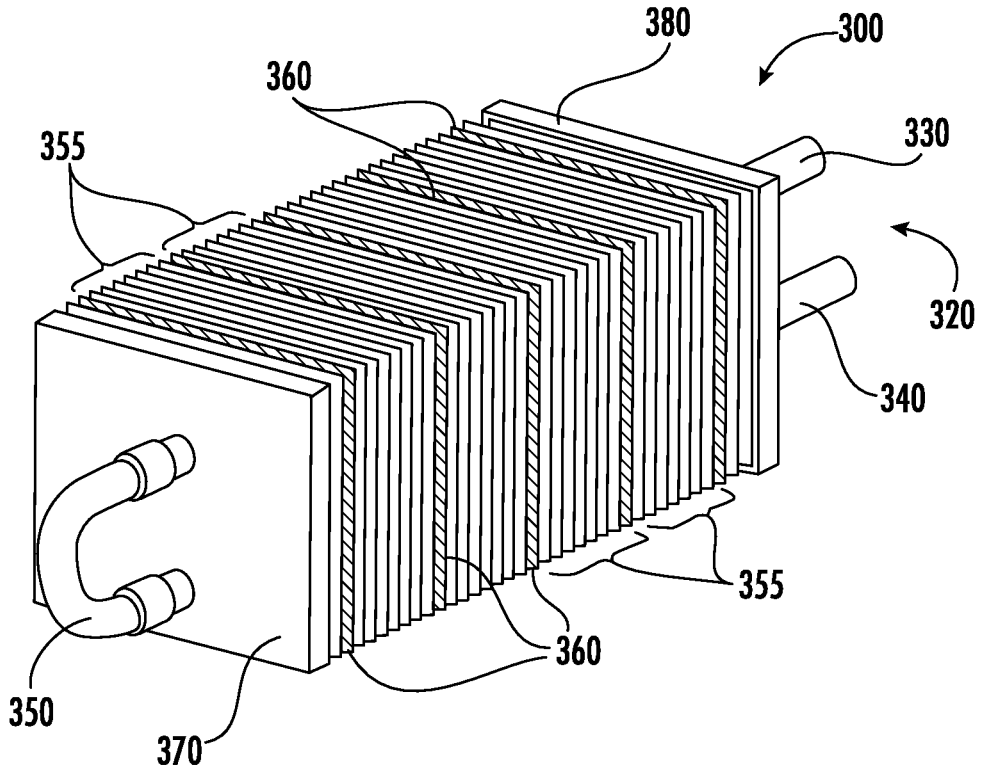
FIG. 1 shows a perspective view of a round tube plate fin heat exchanger or portion thereof with interspersed sacrificial fins.

Referring now to FIG. 1, an exemplary round tube plate fin (RTPF) heat exchanger 300 is shown. The heat exchanger 300 can include one or more flow circuits for carrying refrigerant. For the purposes of explanation, a portion of the heat exchanger 300 is shown with a single flow circuit refrigerant tube 320 in FIG. 1 consisting of an inlet line 330 and an outlet line 340. The inlet line 330 is connected to the outlet line 340 at one end of the heat exchanger 300 through a 90 degree tube bend 350. It will be evident to the skilled person, however, that more circuits may be added to the unit depending upon the demands of the system. For example, although tube bend 350 is shown as a separate component connecting two straight tube section, the tube 320 can also be formed as a single tube piece with a hairpin section therein for the tube bend 350, and multiple units of such hairpin tubes can be connected with u-shaped connectors at the open ends to form a continuous longer flow path in a 'back-and-forth' configuration. Alternatively, the tubes can be configured as separate tube segments in parallel between headers on each end (not shown).

The heat exchanger tubes can be made of an aluminum alloy based core material and, in some embodiments, may be made from aluminum alloys selected from 1000 series, 3000 series, 5000 series, or 6000 series aluminum alloys. The fins can include aluminum alloy substrate materials including but not limited to materials selected from the 1000 series, 3000 series, 6000 series, 7000 series, or 8000 series aluminum alloys (as used herein, all aluminum alloy designations are according to the as specified by The Aluminum Association according to the publication "International Alloy Designations and Chemical Composition Limits for Wrought Aluminum and Wrought Aluminum Alloys" or equivalent publication).

Figure 2:
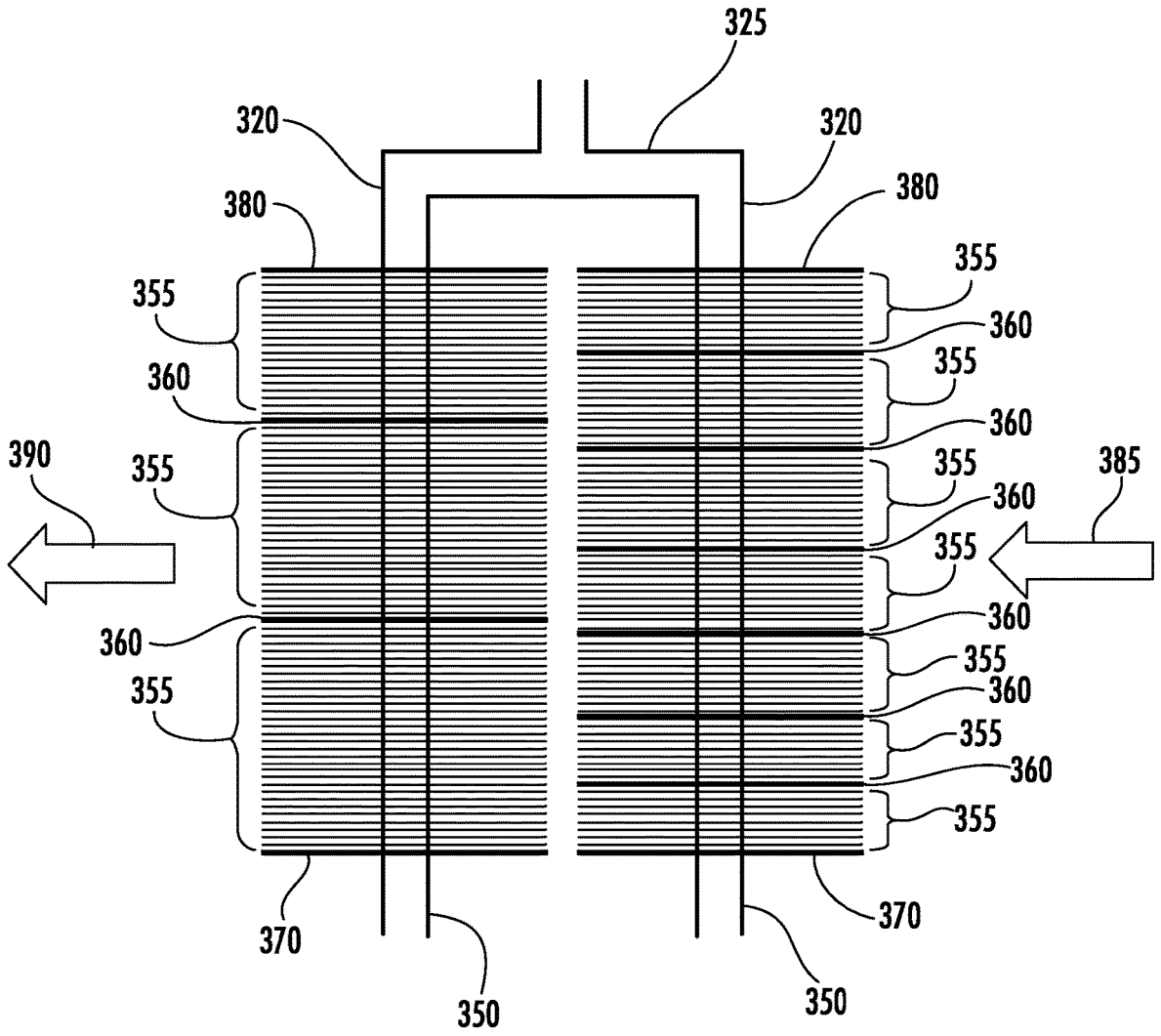
FIG. 2 is a top view of a heat exchanger including two portions from FIG. 1 with a distribution of interspersed sacrificial fins.

The heat exchanger 300 further includes a series of fins comprising radially disposed plate-like elements spaced along the length of the flow circuit, typically connected to the tube(s) 320 with an interference fit. The fins include a first plurality of fins 355, with a second plurality of fins 360 interspersed among the first plurality of fins 355. The fins 355/360 are provided between a pair of end plates or tube sheets 370 and 380 and are supported by the tubes 320 (i.e., tubes 330 and 340 as shown in FIG. 2) to define a gas flow passage through which conditioned air or outside air passes over the tube(s) 320 and between the spaced fins. The fins can optionally include heat transfer enhancement elements such as louvers.

The fins 355 can be formed from or otherwise include a second aluminum alloy, which can be any aluminum alloy useful for fabricating fin stock, including but not limited to AA1000, AA3000, AA5000, AA7000, AA AA8000 series alloys such as AA1100, AA1145, AA3003. AA3102, AA5052. AA7072, AA8005, or AA8011. In some embodiments, the second aluminum alloy has equivalent nobility to the first aluminum alloy so that it is not galvanically sacrificial with respect to the first aluminum alloy. By equivalent nobility, it is meant that any difference in galvanic potential between the first and second aluminum alloys is not sufficient to promote sacrificial galvanic corrosion. In some embodiments, the second aluminum alloy is less noble than the first aluminum alloy to provide sacrificial corrosion protection to the heat exchanger tube. By "less noble", it is meant that the second aluminum alloy is galvanically anodic with respect to the first aluminum alloy, i.e., that the second alloy has a lower galvanic potential or a lower electrode potentials than the first aluminum alloy such that the second aluminum alloy would be anodic with respect to the first aluminum alloy in a galvanic cell. This allows the second aluminum alloy to provide sacrificial corrosion protection to the first aluminum alloy. In some embodiments, the difference in electrode potential between the first alloy and a less noble second alloy is in a range having a lower end of >0 V, 30 mV, or 80 mV, and an upper end of 150 mV, 250 mV, or 340 mV. These range endpoints can be independently combined to form a number of ranges (e.g., 0-150 mV, 0-250 mV, 0-340 mV, 30-150 mV, 30-250 mV, 30-340 mV, 80-150 mV, 80-250 mV, 80-340 mV), and each possible combination is hereby expressly disclosed. Electrode potential can be characterized with respect to a saturated calomel, although the type of electrode should not matter as long as the electrode potential for both alloys is characterized with respect to the same electrode. These range endpoints can be independently combined to produce different ranges, each of which is hereby explicitly disclosed. In some embodiments, the second aluminum alloy can be provided with reduced nobility by incorporating alloying elements such as zinc or magnesium. In some embodiments where zinc is present, the zinc can be present in the second aluminum alloy at a level in a range with a lower end of >0 wt. %, 0.8 wt. %, or 4.0 wt. %, zinc and an upper end of 1.3 wt. %, 5.0 wt. %, or 10.0 wt. %. These range endpoints can be independently combined to form a number of ranges, and each possible combination (i.e., 0-1.3 wt. %, 0-5.0 wt. %, 0-10 wt. %, 0.8-1.3 wt. %, 0.8-5.0 wt. %, 0.8-10 wt. %, 4.0-5.0 wt. %, 4.0-10 wt. %, and excluding impossible combinations where a 'lower' endpoint would be greater than an 'upper' endpoint) is hereby expressly disclosed. In some embodiments where magnesium is present, the magnesium can be present in the second aluminum alloy at a level in a range with a lower end of >0 wt. %, 0.05 wt. %, 1.0 wt. %, 1.3 wt. % or 2.2 wt. %, and an upper end of 0.4 wt. %, 1.3 wt. %, 2.8 wt. %, or 4.9 wt. %. These range endpoints can be independently combined to form a number of ranges, and each possible combination is hereby expressly disclosed. The second alloy does not need to include an anti-passivation alloying element such as tin, indium, or gallium, and in some embodiments the second aluminum alloy is free of tin, indium, and gallium. The second alloy can also include one or more other alloying elements for aluminum alloys. The second alloy can also include one or more other alloying elements for aluminum alloys. In some embodiments, the amount of any individual other alloying element can range from 0-1.5 wt. %. In some embodiments, the total content of any such other alloying elements can range from 0-2.5 wt. %. Examples of such alloying elements include Si, Fe, Mn, Cu, Ti, or Cr.

The fins 360 are formed from or otherwise include a third aluminum alloy, which is less noble than the first aluminum alloy and is less noble than the second aluminum alloy. In some embodiments, the fins 360 can be formed from the third aluminum alloy. In some embodiments, the third aluminum alloy can be overlaid onto all or part of an aluminum alloy substrate, and can applied by various techniques including but not limited to thermal spray (e.g., cold spray), brazing, electroplating, or roll cladding. The third aluminum alloy can be selected or derived from aluminum alloys in from AA5000, or AA7000 series aluminum alloys such as AA5052, AA7072. In some embodiments, the difference in galvanic potential between the third aluminum alloy, and the nearest potential of the first and second aluminum alloys is in a range having a lower end of >0 V, 50 mV, or 150 mV, and an upper end of 400 mV, 650 mV, or 900 mV. These range endpoints can be independently combined to form a number of ranges, and each possible combination is hereby expressly disclosed. In some embodiments, the third aluminum alloy can be provided with reduced nobility by incorporating alloying elements such as zinc or magnesium. In some embodiments where zinc is present, the zinc can be present in the third aluminum alloy at a level in a range with a lower end of 0.5 wt. %, 2.0 wt. %, 2.5 wt. %, or 4.0 wt. %, and an upper end of 4.5 wt. %, 6.0 wt. %, 7.0 wt. %, or 10.0 wt. %. These range endpoints can be independently combined to form a number of ranges, and each possible combination is hereby expressly disclosed. In some embodiments where magnesium is present, the magnesium can be present in the third aluminum alloy at a level in a range with a lower end of 0.5 wt. %, 1.0 wt. %, or 2.2 wt. %, and an upper end of 1.5 wt. %, 2.8 wt. %, or 4.9 wt. %. These range endpoints can be independently combined to produce different ranges, each of which is hereby explicitly disclosed. The third aluminum alloy also includes one or more alloying elements selected from tin, indium, or gallium. In some embodiments, the selected alloying element(s) can be present in the third aluminum alloy at a level in a range with a lower end of 0.010 wt. %, 0.016 wt. %, or 0.020 wt. %, and an upper end of 0.020 wt. %, 0.035 wt. %, 0.050 wt. %, or 0.100 wt. %. These range endpoints can be independently combined to produce different possible ranges, each of which is hereby explicitly disclosed (i.e., 0.010-0.020 wt. %, 0.010-0.035 wt. %, 0.010-0.050 wt. %, 0.010-0.100 wt. %, 0.016-0.020 wt. %, 0.016-0.035 wt. %, 0.016-0.050 wt. %, 0.016-0.100 wt. %, 0.020-0.020 wt. %, 0.020-0.035 wt. %, 0.020-0.050 wt. %, 0.020-0.100 wt. %). The third alloy can also include one or more other alloying elements for aluminum alloys. The second alloy can also include one or more other alloying elements for aluminum alloys. In some embodiments, the amount of any individual other alloying element can range from 0-1.5 wt. %. In some embodiments, the total content of any such other alloying elements can range from 0-2.5 wt. %. Examples of such alloying elements include Si, Fe, Mn, Cu, Ti, or Cr. In some embodiments, the third aluminum alloy can have a composition consisting of: 4.0-6.0 wt. % zinc or magnesium, 0.001-0.1 wt. % of one or more alloying elements selected from tin, indium, gallium, or combinations thereof, 0-2.5 wt. % other alloying elements, and the balance aluminum.

Figure 3:
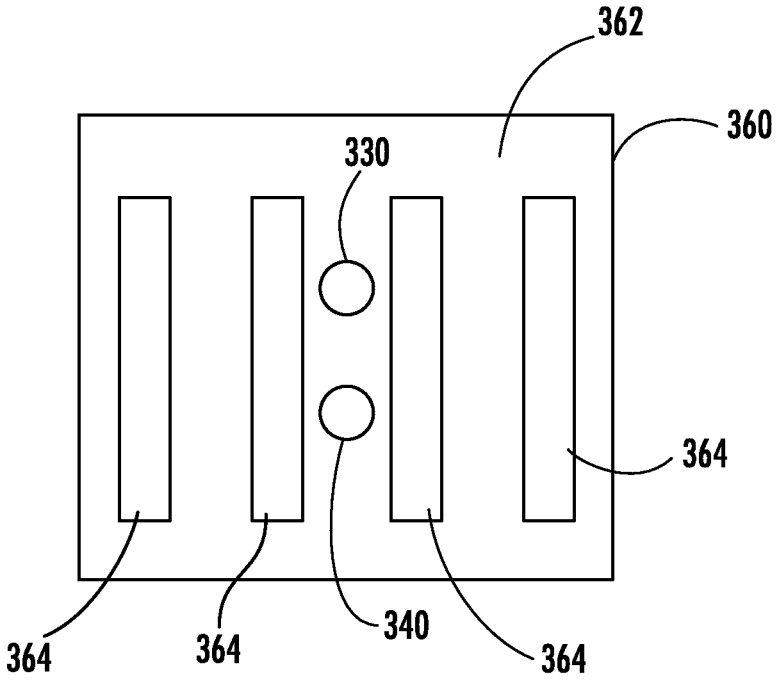
FIG. 3 is a front view of a fin with strips of sacrificial material.

In some embodiments, the fins 360 can be interspersed among the fins 355 at regular intervals as shown in FIG. 1. In some embodiments, fins 360 can be interspersed among the fins 355 at irregular intervals, or randomly, or according to a pattern. In some embodiments, the number of interspersed fins 360 compared to the number of fins 355 can be in a range of 1:2 to 30:1. In some embodiments, the third aluminum alloy can be arranged isotropically with respect to a direction of fluid flow as shown in FIG. 1, which can be accomplished with an isotropic distribution of third aluminum alloy on the fins 360 as shown in FIG. 1 when the fins 360 are formed from or fully clad with the third aluminum alloy, or have an isotropic distribution of the third aluminum alloy on a surface portion of the fins 360 portion (FIG. 3). In some embodiments, the fins 360 can be arranged with a distribution, such as a distribution in which the fins 360 are concentrated toward an inlet 385 on a fluid flow path to an outlet 390 as shown in FIG. 2. FIG. 2 shows two heat exchanger passes 300 (FIG. 1) (using the same numbering from FIG. 1 to describe like components) linked together by a manifold 325 and disposed across a fluid flow path (e.g., air flow path) from the inlet 385 to the outlet 390. As shown in FIG. 2, the fins 360 are concentrated along the axis of the heat exchanger pass closest to the inlet 385, with fewer of the fins 360 disposed on the heat exchanger pass further away from the inlet 385.

Figure 4:
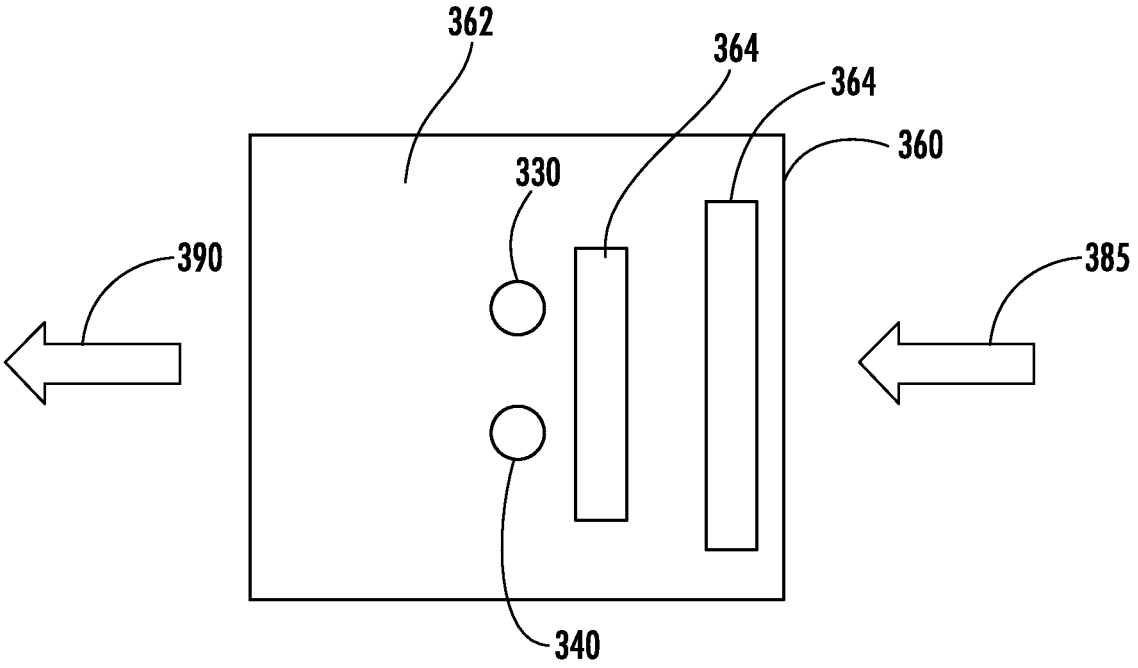
FIG. 4 is a front view of a fin with a distribution of strips of sacrificial material.

The fins 360 can be formed from the third aluminum alloy or can be formed from another finstock alloy such as the second aluminum alloy with the third aluminum alloy covering an outer surface of the other finstock alloy. In some embodiments, the third aluminum alloy can cover the entire outer surface of the fin(s) formed from a different alloy. In some embodiments, the third aluminum alloy can cover a portion of the outer surface of fin(s) formed from a different alloy. Example embodiments of a configuration of a fin 360 with strips 364 of the third aluminum alloy on a fin bas 362 of a different aluminum alloy are schematically shown in FIGS. 3-4, which use the same numbering from FIGS. 1 and 2 to describe like elements. In some embodiments, portions or strips 364 of the third aluminum alloy can be arranged isotopically with respect to a direction of fluid flow as shown in FIG. 3. In some embodiments, the portions or strips 364 of the third aluminum alloy can be arranged with a distribution, such as a distribution in which the portions or strips 364 are concentrated toward an inlet 385 for a fluid flow path to an outlet 390 as shown in FIG. 4.

The fins 355/360 can have a thickness in a range of 0.003 inches to 0.0075 inches for round tube plate fin heat exchangers, or in a range of 0.001 inches to 0.005 inches for microchannel heat exchangers. In some embodiments, the fins 360 can be formed from (e.g., consist of) the third aluminum alloy. In some embodiments, the third aluminum alloy can be disposed as a surface layer over a core fin alloy, in which case the third aluminum alloy can in some embodiments fully encase the core fin alloy, and in some embodiments, the third aluminum alloy can cover only a portion of a core fin alloy. Example embodiments in which the third aluminum alloy covers a portion of a fin are shown in FIGS. 3 and 4.

Figure 5:
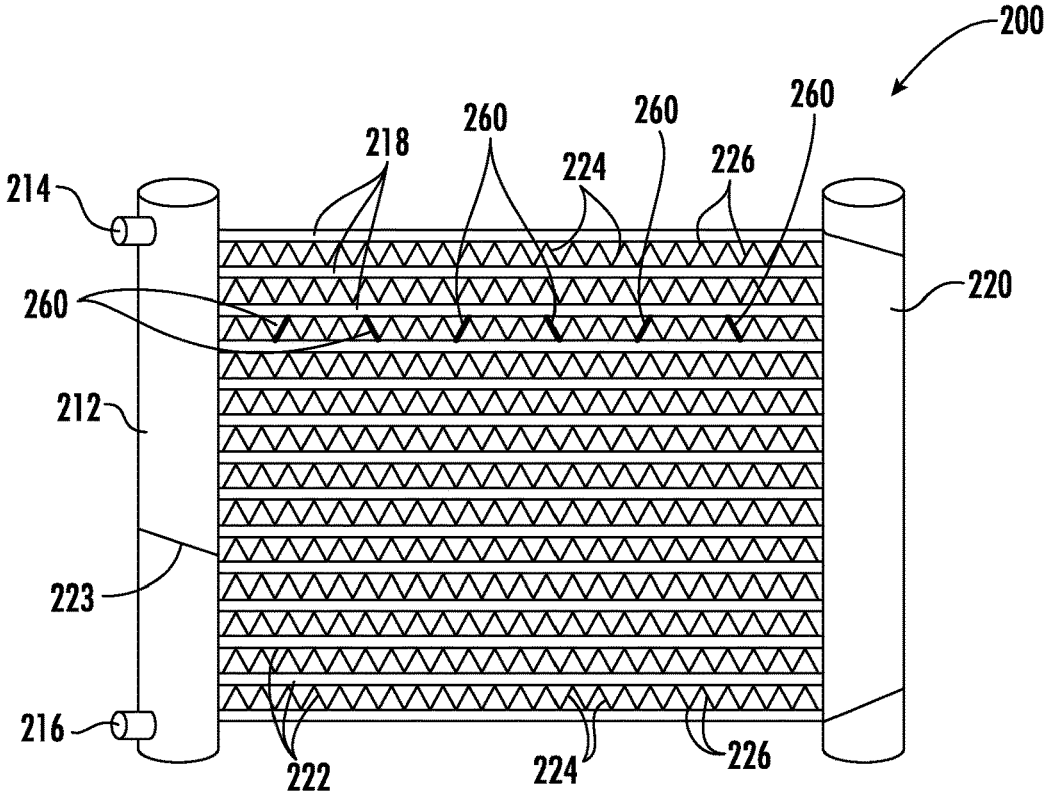
FIG. 5 is a cross-sectional view of a microchannel heat exchanger with interspersed sacrificial fins.

In some embodiments, the interspersed sacrificial fins can be used on heat exchanger fluid guides in a configuration different than the round tube of FIG. 1. For example, in some embodiments interspersed sacrificial fins can be employed with a microchannel heat exchanger configuration. FIG. 5 shows a micro-channel or mini-channel type of heat exchanger. The configuration of these types of heat exchangers is generally the same, with the primary difference being rather loosely applied based on the size of heat transfer tube ports. For the sake of convenience, this type of heat exchanger will be referred to herein as a micro-channel heat exchanger. As shown in FIG. 5, a micro-channel heat exchanger 200 includes first manifold 212 having inlet 214 for receiving a working fluid, such as coolant, and outlet 216 for discharging the working fluid. First manifold 212 is fluidly connected to each of a plurality of tubes 218 that are each fluidly connected on an opposite end with second manifold 220. Second manifold 220 is fluidly connected with each of a plurality of tubes 222 that return the working fluid to first manifold 212 for discharge through outlet 216. Partition 223 is located within first manifold 212 to separate inlet and outlet sections of first manifold 212. Tubes 218 and 222 can include channels, such as microchannels, for conveying the working fluid. The two-pass working fluid flow configuration described above is only one of many possible design arrangements. Single and other multi-pass fluid flow configurations can be obtained by placing partitions 223, inlet 214 and outlet 216 at specific locations within first manifold 212 and second manifold 220.

With continued reference to FIG. 5, fins 224 are shown extending between tubes 218 and the tubes 222 as shown in the Figure. Fins 224 support tubes 218 and tubes 222 and establish open flow channels between the tubes 218 and tubes 222 (e.g., for airflow) to provide additional heat transfer surfaces and enhance heat transfer characteristics. Fins 224 also provide support to the heat exchanger structure. Fins 224 are bonded to tubes 218 and 222 at brazed joints 226. Fins 224 are not limited to the triangular cross-sections shown in FIG. 5, as other fin configurations (e.g., rectangular, trapezoidal, oval, sinusoidal) can be used as well. Fins 224 may also have louvers to improve heat transfer. The heat exchanger 200 also includes interspersed sacrificial fins 260. With respect to continuous corrugated fin configurations such as shown in FIG. 5, each corrugated fin segment can be considered as a distinct fin for the purpose of arrangement of first and second pluralities of fins including second and third aluminum alloys, respectively. The interspersed sacrificial fins 260 can be integrated into a continuous corrugated fin structure with strips comprising the third aluminum alloy integrated onto portions of a base fin stock, as shown above in FIGS. 3 and 4.

Figure 6:
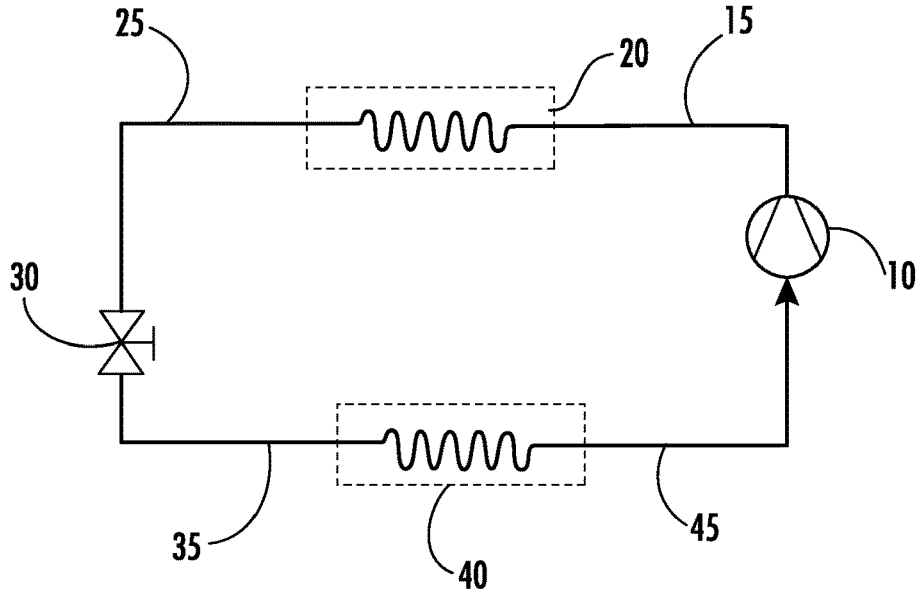
FIG. 6 schematically shows a heat transfer system.

The heat exchanger embodiments disclosed herein can be used in a heat transfer system. Referring now to the FIG. 6, an exemplary heat transfer system with a heat transfer fluid circulation loop is schematically shown in block diagram form. As shown in FIG. 6, a compressor 10 pressurizes a refrigerant or heat transfer fluid in its gaseous state, which both heats the fluid and provides pressure to circulate it throughout the system. The hot pressurized gaseous heat transfer fluid exiting from the compressor 10 flows through conduit 15 to heat rejection heat exchanger 20, which functions as a heat exchanger to transfer heat from the heat transfer fluid to the surrounding environment, resulting in condensation of the hot gaseous heat transfer fluid to a pressurized moderate temperature liquid. The liquid heat transfer fluid exiting from the heat rejection heat exchanger 20 (e.g., a condenser) flows through conduit 25 to expansion valve 30, where the pressure is reduced. The reduced pressure liquid heat transfer fluid exiting the expansion valve 30 flows through conduit 35 to heat absorption heat exchanger 40 (e.g., an evaporator), which functions as a heat exchanger to absorb heat from the surrounding environment and boil the heat transfer fluid. Gaseous heat transfer fluid exiting the heat rejection heat exchanger 40 flows through conduit 45 to the compressor 10, thus completing the heat transfer fluid loop. The heat transfer system has the effect of transferring heat from the environment surrounding the evaporator 40 to the environment surrounding the heat rejection heat exchanger 20. The thermodynamic properties of the heat transfer fluid allow it to reach a high enough temperature when compressed so that it is greater than the environment surrounding the condenser 20, allowing heat to be transferred to the surrounding environment. The thermodynamic properties of the heat transfer fluid must also have a boiling point at its post-expansion pressure that allows the environment surrounding the heat rejection heat exchanger 40 to provide heat at a temperature to vaporize the liquid heat transfer fluid. The heat exchanger embodiments described herein can be used for the heat rejection heat exchanger 20 or the heat absorption exchanger 40.

The heat transfer system shown in FIG. 6 can be used as an air conditioning system, in which the exterior of heat rejection heat exchanger 20 is contacted with air in the surrounding outside environment and the heat absorption heat exchanger 40 is contacted with air in an interior environment to be conditioned. Additionally, as is known in the art, the system can also be operated in heat pump mode using a standard multiport switching valve to reverse heat transfer fluid flow direction and the function of the condensers and evaporators, i.e. the condenser in a cooling mode being evaporator in a heat pump mode and the evaporator in a cooling mode being the condenser in a heat pump mode. Additionally, while the heat transfer system shown in FIG. 6 has evaporation and condensation stages for highly efficient heat transfer, other types of heat transfer fluid loops are contemplated as well, such as fluid loops that do not involve a phase change, for example, multi-loop systems such as commercial refrigeration or air conditioning systems where a non-phase change loop thermally connects one of the heat exchangers in an evaporation/condensation loop like FIG. 6 to a surrounding outside environment or to an interior environment to be conditioned.

To the extent used herein, the term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heat exchanger comprising:

a hollow tube comprising a first aluminum alloy extending along an axis from a tube inlet to a tube outlet;

a first plurality of fins comprising a second aluminum alloy extending outwardly from an outer surface of the tube;

a second plurality of fins comprising a third aluminum alloy extending outwardly from the outer surface of the tube, interspersed along the axis with the fins comprising the second aluminum alloy, wherein the third aluminum alloy is less noble than each of the first aluminum alloy and the second aluminum alloy, and comprises an alloying element selected from tin, indium, gallium, or combinations thereof;

a first fluid flow path through hollow tube from the tube inlet to the tube outlet; and a second fluid flow path across an outer surface of the hollow tube through spaces between adjacent fins.

2. The heat exchanger of claim 1, wherein a ratio of the number of fins in the first plurality of fins to the number of fins in the second plurality of fins is from 1:2 to 30:1.

3. The heat exchanger of claim 1, wherein the interspersal of the second plurality of fins among the first plurality of fins is evenly distributed along the axis.

4. The heat exchanger of claim 1, wherein the second plurality of fins are concentrated toward an inlet to a fluid flow path on the outside of the tube between the first plurality of fins.

5. The heat exchanger of claim 1, wherein the first plurality of fins is free of the third aluminum alloy.

6. The heat exchanger of claim 1, wherein the third alloy further comprises zinc or magnesium.

7. The heat exchanger of claim 1, wherein the second aluminum alloy is less noble than the first aluminum alloy.

8. The heat exchanger of claim 1, wherein the second plurality of fins individually include the third aluminum alloy along the entirety of its surface.

9. The heat exchanger of claim 1, wherein the second plurality of fins individually include the third aluminum alloy along less than the entirety of its surface.

10. The heat exchanger of claim 1, wherein the hollow tube is configured as a hollow cylinder.

11. The heat exchanger of claim 1, wherein the first and second pluralities of fins are arranged as plates that include openings through which the hollow tube is disposed.

12. The heat exchanger of claim 11, comprising a plurality of hollow tubes or a plurality of hollow tube sections extending parallel to said axis.

13. A heat transfer system comprising a heat transfer fluid circulation loop in operative thermal communication with a heat source and a heat sink, wherein the heat exchanger of claim 1 is disposed as a thermal transfer link between the heat transfer fluid and the heat sink or heat source.

14. A heat transfer system comprising a heat transfer fluid circulation loop in operative thermal communication with an indoor conditioned air space and an outdoor air space, including the heat exchanger of claim 1 arranged with the first fluid flow path in operative fluid communication with the heat transfer fluid circulation loop.

15. The heat transfer system of claim 14, wherein the second fluid flow path is in operative fluid communication with the conditioned air space.

16. The heat transfer system of claim 14, wherein the second fluid flow path is in operative fluid communication with the outdoor air space.

* * * * *